US009494960B2

(12) United States Patent
Weerakoon et al.

(10) Patent No.: US 9,494,960 B2
(45) Date of Patent: Nov. 15, 2016

(54) VOLTAGE REGULATOR PROGRAMMABLE AS A FUNCTION OF LOAD CURRENT

(71) Applicant: Boston Scientific Neuromodulation Corporation, Valenica, CA (US)

(72) Inventors: Pujitha Weerakoon, Valencia, CA (US); Goran N. Marnfeldt, Valencia, CA (US)

(73) Assignee: Boston Scientific Neuromodulation Corporation, Valencia, CA (US)

( * ) Notice: Subject to any disclaimer, the term of this patent is extended or adjusted under 35 U.S.C. 154(b) by 60 days.

(21) Appl. No.: 14/169,533

(22) Filed: Jan. 31, 2014

(65) Prior Publication Data

US 2014/0266101 A1 Sep. 18, 2014

Related U.S. Application Data

(60) Provisional application No. 61/783,867, filed on Mar. 14, 2013.

(51) Int. Cl.
*G05F 1/565* (2006.01)
*G05F 1/575* (2006.01)

(52) U.S. Cl.
CPC ..... *G05F 1/575* (2013.01); *G05F 1/565* (2013.01)

(58) Field of Classification Search
USPC ..... 323/234, 237, 265, 273–275, 282–284
See application file for complete search history.

(56) References Cited

U.S. PATENT DOCUMENTS

| | | | | |
|---|---|---|---|---|
| 6,516,227 | B1 | 2/2003 | Meadows et al. | |
| 7,177,698 | B2 | 2/2007 | Klosterman et al. | |
| 8,278,997 | B1 * | 10/2012 | Kim | G06F 1/26 327/541 |
| 2005/0088159 | A1 * | 4/2005 | Itohara | 323/284 |
| 2008/0100232 | A1 * | 5/2008 | Miguchi | 315/294 |
| 2008/0224768 | A1 * | 9/2008 | Yen et al. | 330/9 |
| 2012/0095529 | A1 | 4/2012 | Parramon et al. | |
| 2013/0023943 | A1 | 1/2013 | Parramon et al. | |
| 2013/0211469 | A1 | 8/2013 | Lamont et al. | |
| 2013/0314061 | A1 * | 11/2013 | Forghani-zadeh et al. | 323/271 |
| 2013/0331910 | A1 | 12/2013 | Lamont et al. | |

* cited by examiner

*Primary Examiner* — Jeffrey Gblende
(74) *Attorney, Agent, or Firm* — Lewis, Reese & Nesmith, PLLC

(57) ABSTRACT

A programmable linear voltage regulator and system for programming the regulator that improves the speed, power usage, and stability over conventional linear voltage regulators is disclosed. A controller that has knowledge of the current or expected activation of various loads sends bias control signals to a programmable biasing circuit of an error amplifier in the voltage regulator to adjust the bias current in accordance with the load current the regulator produces or is expected to produce. A look up table associated with the controller can be used to correlate the bias control signals with current or expected load conditions. Programming of the programmable biasing circuit may precede the enablement of a new load condition to ready the voltage regulator to handle the upcoming change in load current.

42 Claims, 10 Drawing Sheets

170

| Enable signals 82a, b, c | Load 72a | Load 72b | Load 72c | Iload (μA) | Ideal Ibias =0.1% Iload (μA) | bias control signals 102a, b, c |
|---|---|---|---|---|---|---|
| 000 | off | off | off | 0 | 0 | 000 |
| 001 | off | off | on | 1105.3 | 1.1 | 001 |
| 010 | off | on | off | 3.5 | 0 | 000 |
| 011 | off | on | on | 1108.8 | 1.1 | 001 |
| 100 | on | off | off | 15100 | 15.1 | 110 |
| 101 | on | off | on | 16205.3 | 16.2 | 110 |
| 110 | on | on | off | 15103.5 | 15.1 | 110 |
| 111 | on | on | on | 16208.8 | 16.2 | 110 |

172

| bias control signals 102a, b, c | Stage 156a | Stage 156b | Stage 156c | Ibias (μA) |
|---|---|---|---|---|
| 000 | off | off | off | 0.8 |
| 001 | off | off | on | 1.8 |
| 010 | off | on | off | 6.8 |
| 011 | off | on | on | 7.8 |
| 100 | on | off | off | 10.8 |
| 101 | on | off | on | 11.8 |
| 110 | on | on | off | 16.8 |
| 111 | on | on | on | 17.8 |

*Figure 7*

170

| Enable signals 82a, b, c | Load 72a | Load 72b | Load 72c | Iload (μA) | bias control signals 102a, b, c |
|---|---|---|---|---|---|
| 000 | off | off | off | 0 | 000 |
| 001 | off | off | on | X | 001 |
| 010 | off | on | off | 3X | 010 |
| 011 | off | on | on | 4X | 011 |
| 100 | on | off | off | 6X | 100 |
| 101 | on | off | on | 7X | 101 |
| 110 | on | on | off | 9X | 110 |
| 111 | on | on | on | 10X | 111 |

172

| bias control signals 102a, b, c | Stage 156a | Stage 156b | Stage 156c | Ibias (μA) - Imin |
|---|---|---|---|---|
| 000 | off | off | off | 0 |
| 001 | off | off | on | 0.001X |
| 010 | off | on | off | 0.003X |
| 011 | off | on | on | 0.004X |
| 100 | on | off | off | 0.006X |
| 101 | on | off | on | 0.007X |
| 110 | on | on | off | 0.009X |
| 111 | on | on | on | 0.010X |

*Figure 9*

VOLTAGE REGULATOR PROGRAMMABLE AS A FUNCTION OF LOAD CURRENT

CROSS REFERENCE TO RELATED APPLICATIONS

This is a non-provisional application of U.S. Provisional Patent Application Ser. No. 61/783,867, filed Mar. 14, 2013, which is incorporated herein by reference in its entirety, and to which priority is claimed.

FIELD OF THE INVENTION

The present invention relates generally to implantable medical devices, and more particularly to an improved voltage regulator for use in implantable medical devices.

BACKGROUND

Implantable stimulation devices generate and deliver electrical stimuli to nerves and tissues to treat various biological disorders. Examples include pacemakers to treat cardiac arrhythmia, defibrillators to treat cardiac fibrillation, cochlear stimulators to treat deafness, and various neural stimulators to treat urinary incontinence, sleep apnea, shoulder subluxation, etc. Implantable stimulation devices may be used within various implantable medical device systems. For example, an implantable stimulation device may comprise a Spinal Cord Stimulator (SCS), such as that disclosed in U.S. Pat. No. 6,516,227. However, the present invention may find applicability in any implantable medical device system.

As shown in FIGS. 1A-1C, an SCS system typically includes an Implantable Pulse Generator (IPG) 10, which includes a biocompatible device case 12 formed of titanium for example. The case 12 typically holds the circuitry and battery 14 necessary for the IPG 10 to function, although IPGs can also be powered via external RF energy, without a battery. The IPG 10 is coupled to electrodes 16 via one or more electrode leads (two such leads 18 and 20 are shown) such that the electrodes 16 form an electrode array. The electrodes 16 are carried on a flexible body 24, which also houses the individual signal wires 22 coupled to each electrode. In the illustrated embodiment, there are eight electrodes on lead 18, labeled E1-E8, and eight electrodes on lead 20, labeled E9-E16, although the number of arrays and electrodes is application specific and therefore can vary. The leads 18 and 20 couple to the IPG 10 using lead connectors 26 fixed in a header 28. The IPG 10 has a telemetry coil 32 for communications and charging coil 34 for receiving charging energy from an external charger to charge the IPG's battery 14. (FIG. 1B shows the IPG 10 with the case 12 removed to ease the viewing of the two coils 32 and 34).

As shown in the cross-section of FIG. 1C, the IPG 10 typically includes a printed circuit board (PCB) 30, upon which various electronic components 38 are mounted. The electronic components 38 can include an Application Specific Integrated Circuit (ASIC), such as that disclosed in U.S. Patent Application Publication 2013/0023943. Such an ASIC contains a number of circuit modules that perform various functions of within the IPG including, for example, delivery of stimulation, battery charging functions, and telemetry.

Often, such modules require a regulated, stable, noise-free, and accurate voltage source as a power supply, which can be provided by a regulation system 5 including a linear voltage regulator 50 as illustrated in FIG. 2. Voltage regulator 50 generates a regulated voltage source, Vload, from another power supply, Vin, resident in the IPG 10. For example, Vin can comprise the voltage of the IPG's battery 14. Voltage regulator 50 can be incorporated into the ASIC along with the modules it powers.

The architecture of the conventional linear voltage regulator 50 includes an error amplifier 52, a pass element 54, a reference voltage circuit 56, and a feedback circuit 58. The error amplifier 52 (discussed later in greater detail with respect to FIG. 3) has an inverting input 62 (−), a non-inverting input 60 (+), and an output 64. The non-inverting input 60 (+) is coupled to a reference voltage Vref which is output from the reference voltage circuit 56. The reference voltage circuit 56 may be a band-gap generator, or other suitable voltage reference circuit. The feedback circuit 58, here, is a voltage divider comprising a first feedback resistor R1 and a second feedback resistor R2 connected in series between the output (Vload) of the voltage regulator 50 and ground (GND). The voltage divider output (feedback voltage) 66 serves as the feedback connection to the inverting input 62 of the amplifier 52.

The error amplifier output 64 is coupled to the gate of the pass element 54, realized here using a large PMOS transistor to improve the efficiency of the regulator. The source of the PMOS transistor is connected to Vin and its drain is connected to the feedback circuit 58 and to output Vload of the regulator 50.

The pass element 54 behaves as a variable power switch turning more "on" or "off" depending on the change in the feedback circuit output 66. The error amplifier output 64 controls the voltage drop across the pass element 54 to control the output voltage Vload. For example, as the load current Iload increases, Vload will temporarily decrease which causes the feedback voltage 66 to decrease. The error amplifier 52 tries to force the voltages at its inputs 60 and 62 to be equal and will decrease its output 64 to make the pass element 54 more conductive, which increases Vload to bring it back to its original level. One skilled in the art will recognize therefore that Vload is a function of Vref and the resistances used in the feedback circuit 58.

The regulator's output Vload is coupled to a load 70, which may include a number of circuit modules 72*a-c* in the IPG 10, such as those mentioned earlier. Different modules 72 may be active and requiring power at a given time, and so Iload will increase or decrease as the different modules 72 are enabled or disabled. Enabling or disabling of the modules 72 is accomplished using a controller 80 (e.g., a microcontroller), which may control other functions in the IPG 10 as well. The controller 80 understands by virtue of its programming which modules 72 are needed at a given time, and so can enable such modules via load enable signals 82. Each module 72*a-c* receives a unique load enable signal 82*a-c*. As one skilled understands, enabling a particular module (say 72*b* via load enable signal 82*b*) will couple that module to Vload, thus allowing it to be powered and operate as required. Other disabled modules are decoupled from Vload.

To assist with keeping Vload constant when Iload changes, a smoothing capacitor C is coupled to Vload. The size (i.e., width/length) of the pass element 54 and the value of C are generally chosen in accordance with a maximum expected Iload, i.e., when all modules 72*a-c* are active.

FIG. 3 is a circuit diagram for the error amplifier 52 which employs a conventional a CMOS differential amplifier. The amplifier output 64, as discussed previously, drives the pass element 54 of FIG. 2. The amplifier inputs 60 and 62 are coupled to the gates of input NMOS transistors 86*a* and 86*b* forming a differential pair 90. The amplifier 52 has an active load 88, shown here as a current mirror with PMOS load elements 84*a* and 84*b*. Error amplifier 52 can be built in different manners, as one skilled in the art understands.

The amplifier 52 also comprises a fixed biasing circuit 92 for providing a fixed bias current Ibias for the amplifier 52. The bias current Ibias provides a constant current sink, which is generated by a current mirror comprised of NMOS load elements 94*a* and 94*b*. A reference current, Iref, is provided to the current mirror, and the value of Ibias is scaled from Iref depending on the relative sizes of load elements 94*a* and 94*b*; if the transistors 94*a* and 94*b* are the same size, Ibias=N*Iref, where N represents a number of transistors 94*b* wired in parallel.

A minimum Ibias is required to operate the error amplifier 52. However, Ibias is instead typically set to a higher-than-minimum value to handle large swings in Iload. This is because, as the inventors recognize, a high value for Ibias will allow the amplifier 52 to react more quickly to large swings in Iload; in other words, the slew rate of amplifier output 64 increases as Ibias is increased. The inventors recognize the use of high Ibias as unfortunate, as Ibias generally draws current from the IPG's battery 14, which tends to deplete the battery faster, and thus requiring more frequent battery recharging.

FIG. 4 illustrates another problem associated with voltage regulator 50 relating to stability. FIG. 4 shows a Bode plot 95 of the open loop gain characteristics of the regulator 50 for different levels of Iload. Curve 96 shows the open loop gain under a minimum Iload, which occurs when most or all of the modules 72 are deactivated. Curve 97 shows the open loop gain under a maximum Iload, i.e., when most or all of the modules 72 are active. Dominant poles (Po) and secondary poles (Pa) are shown for each of these extreme load conditions. Po is associated with the output of pass element 54, in particular output capacitor C, while Pa is associated with the output resistance and capacitance of the error amplifier 52 including parasitics associated with the pass element 54.

As shown by the arrows in FIG. 4, poles Po and Pa move closer together as Iload increases. This threatens regulator stability, as the regulator may become unstable when more than one pole occurs above the 0 dB threshold. In other words, regulator 50 is susceptible to instability at higher values of Iload.

Prior art techniques to improve stability and slew rate generally involve adding power-hungry circuitry or complex feedback circuits. Therefore, there exists a need for a simple linear voltage regulator that consumes less power without compromising speed of operation or stability.

BRIEF DESCRIPTION OF THE DRAWINGS

FIG. 7 shows two tables illustrating an example of an adjustment to Ibias in the context of changing load conditions.

FIG. 9 shows another example of two tables illustrating an example of an adjustment to Ibias in the context of changing load conditions.

DETAILED DESCRIPTION

A programmable linear voltage regulator and system for programming the regulator that improves the speed, power usage, and stability over conventional linear voltage regulators is disclosed. A controller that has a priori knowledge of the activation of various loads sends bias control signals to a programmable biasing circuit of an error amplifier in the voltage regulator to adjust the bias current in accordance with the load current the regulator produces or is expected to produce. A look up table associated with the controller can be used to correlate the bias control signals with current or expected load conditions. Programming of the programmable biasing circuit may precede the enablement of a new load condition to ready the voltage regulator to handle the upcoming change in load current. By programming the bias current in this fashion, the bias current need not be set to a maximum value capable of handling a maximum load current, as occurred in the prior art. As well as saving power, the adjustment of the bias current renders the voltage regulator more stable, particularly at high load currents.

Figure 1A:
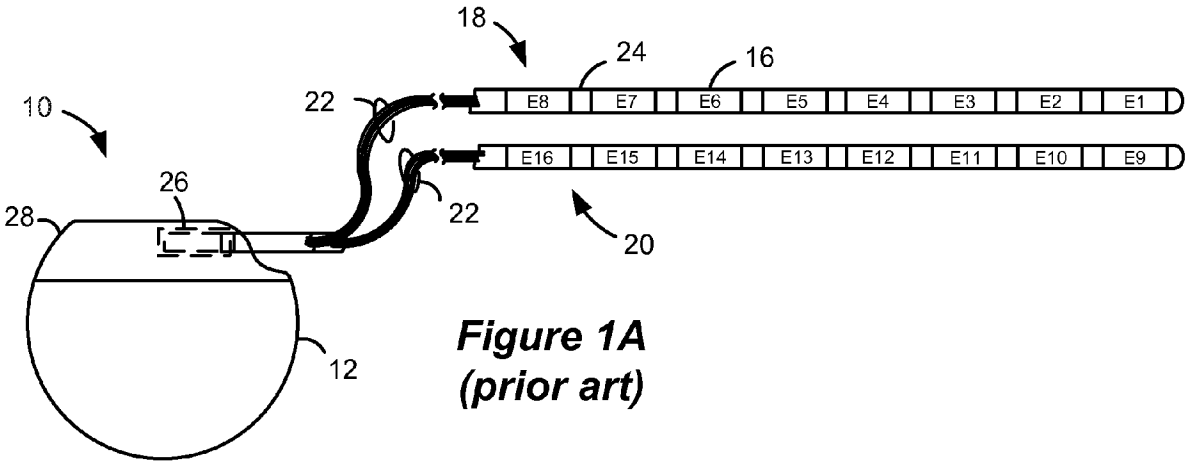
Figure 1A (prior art)
FIGS. 1A-1C show an implantable pulse generator (IPG), and the electrode leads coupled to the IPG in accordance with the prior art.
Figure 1C:
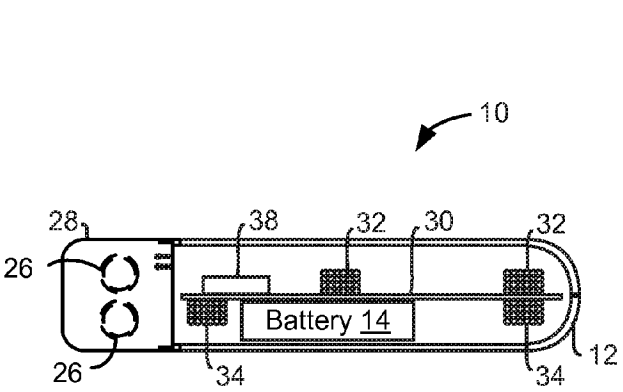
Figure 1C (prior art)
Figure 1B:
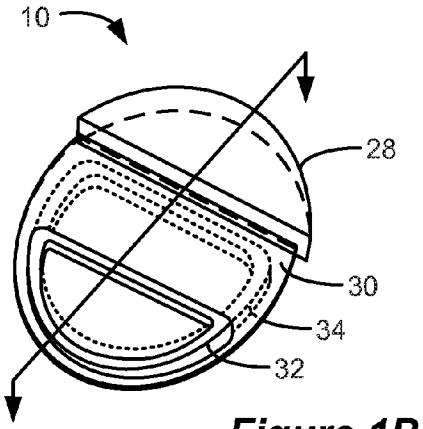
Figure 1B (prior art)
Figure 2:
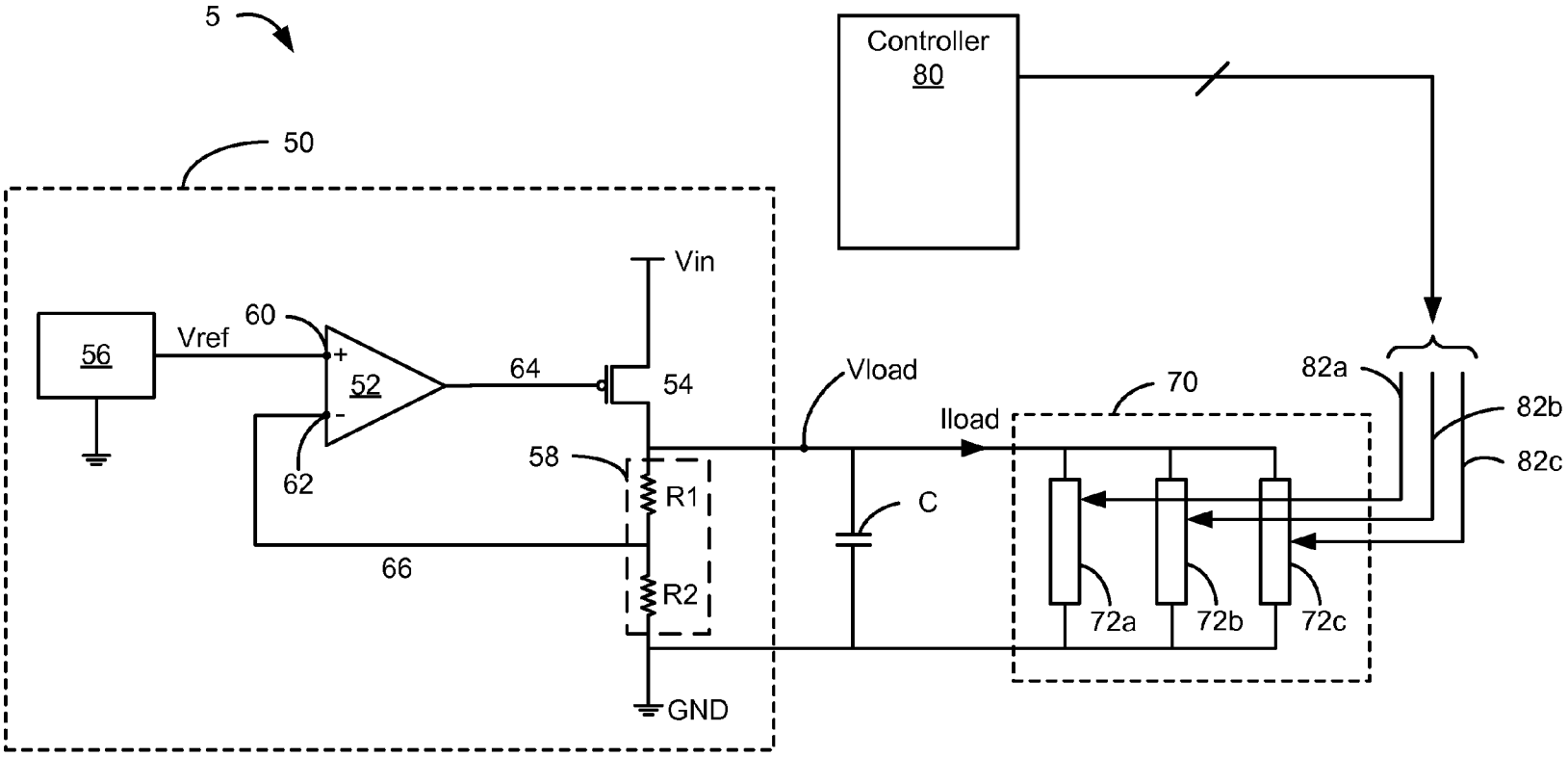
Figure 2 (prior art)
FIG. 2 shows a diagram of a conventional linear voltage regulator for the IPG of FIGS. 1A-1C.
Figure 5:
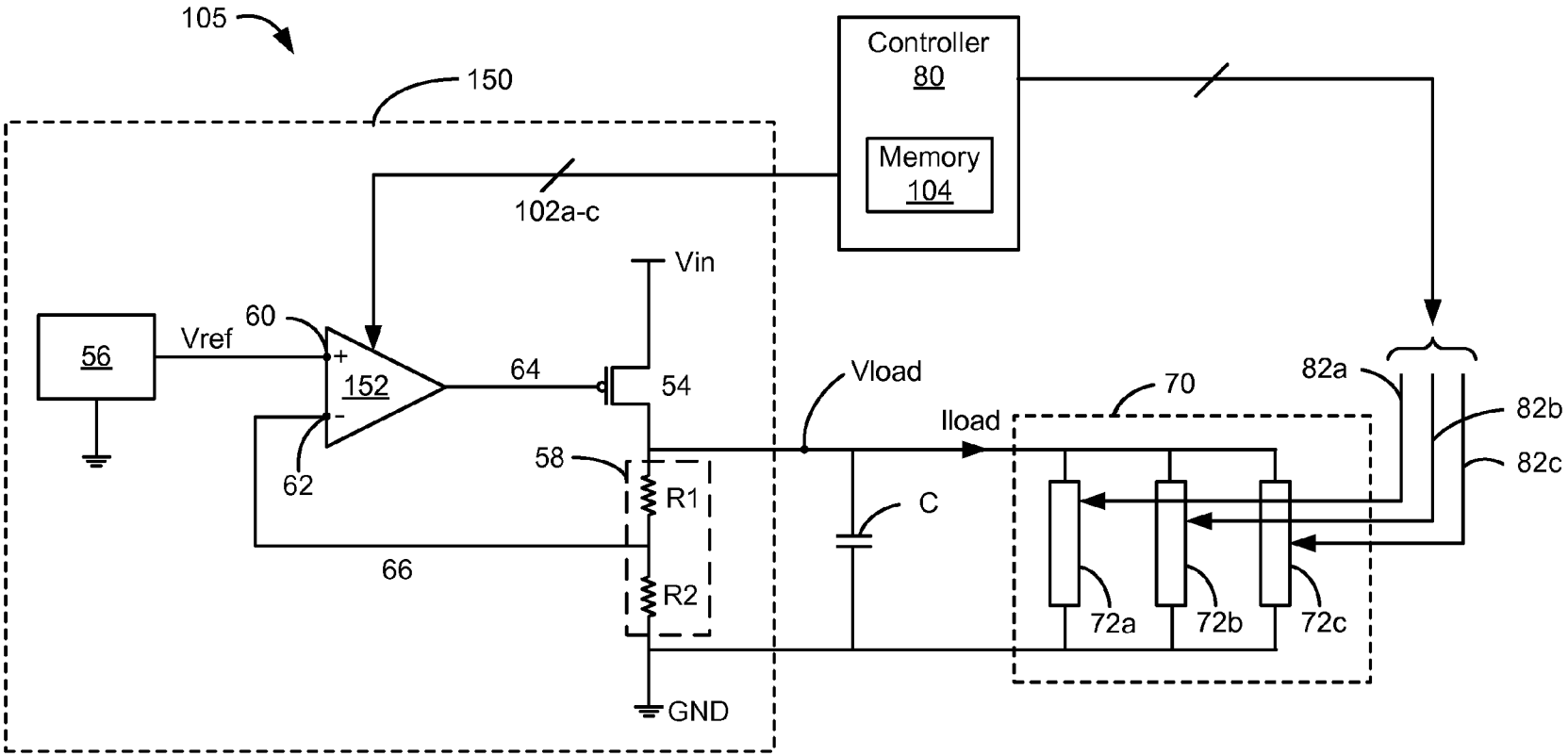
FIG. 5 shows an example of a programmable linear voltage regulator for the IPG of FIG. 1.

FIG. 5 illustrates an improved regulation system 105 for controlling an improved linear voltage regulator 150 for the IPG 10 of FIG. 1. Many of the elements present in system 105 do not differ from system 5 of FIG. 2, and are thus not reiterated here. New to system 105 are bias control signals 102 for programming Ibias in an improved error amplifier 152 in the voltage regulator 150. The controller 80 drives the bias control signals 102 to change Ibias based on knowledge of changes in load conditions that are scheduled, as discussed further below. Also new to system 105 is a memory 104 which stores information correlating Ibias to different load conditions, which is also discussed further below. Prior to the discussion of when Ibias is changed, how Ibias is changed within the error amplifier 152 is discussed first with reference to FIG. 6.

Figure 6:
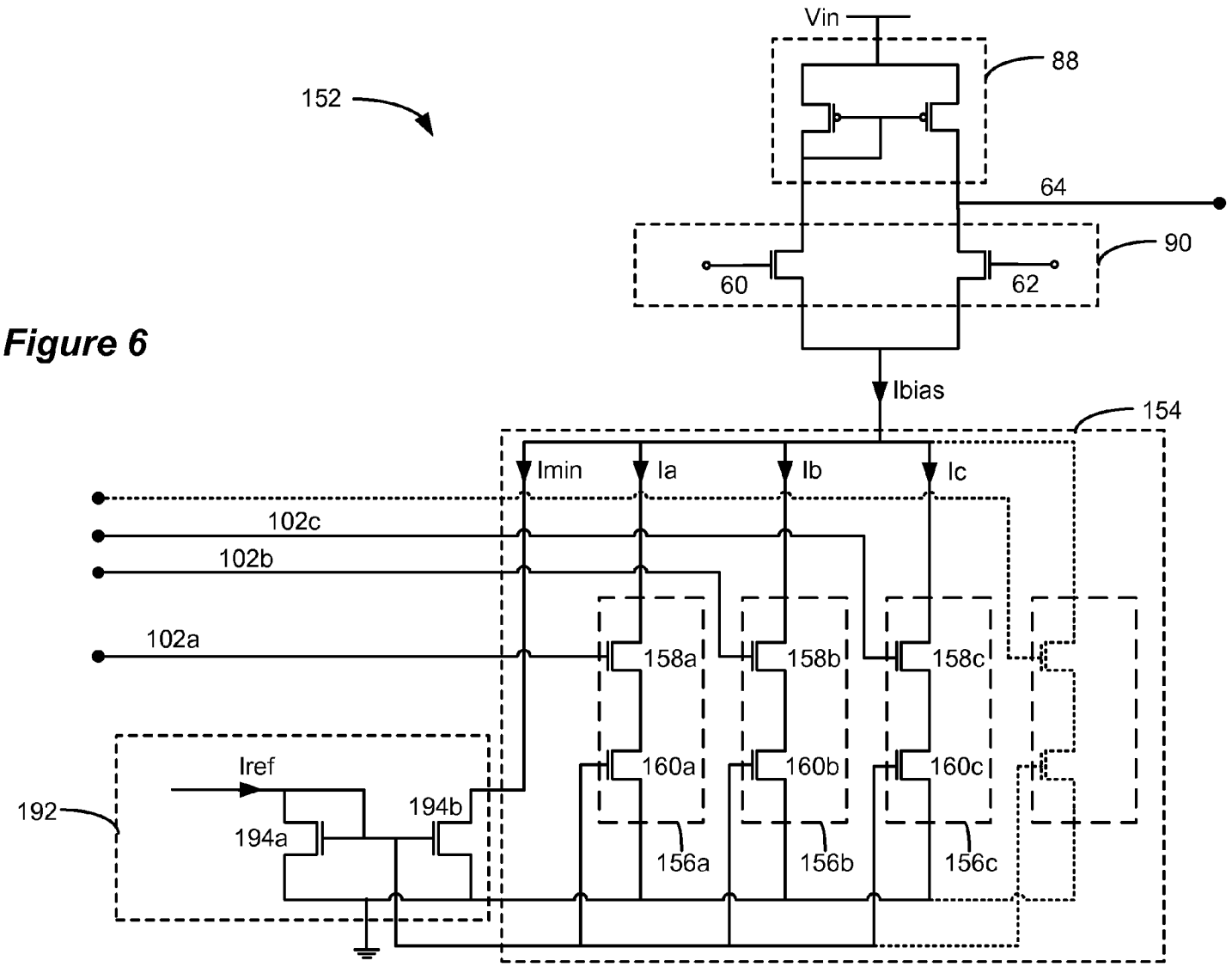
FIG. 6 shows a circuit diagram for a differential amplifier as used in the programmable linear voltage regulator of FIG. 5.

FIG. 6 shows the error amplifier 152, which as before, includes an active load 88, a differential pair 90, and a fixed biasing circuit 192, which is modified as discussed below. Newly added is an adjustable biasing circuit 154, implemented here as a Digital-to-Analog (DAC) converter 154 controlled by the bias control signals 102. The DAC 154 includes a number of stages 156, each of which includes a stage selection transistor 158 controlled by a corresponding bias control signal 102 and current mirror transistors 160. Essentially, when a stage 156 is selected by a particular bias control signal 102, that stage contributes to the magnitude of Ibias provided to the amplifier. For example, when stage selection transistor 158*a* is turned on by bias control signal 102*a*, Ia will be added to Ibias. When stage selection transistors 158*a* and 158*b* are turned on by bias control signals 102*a* and 102*b*, Ia and Ib will be added to Ibias.

Figure 3:
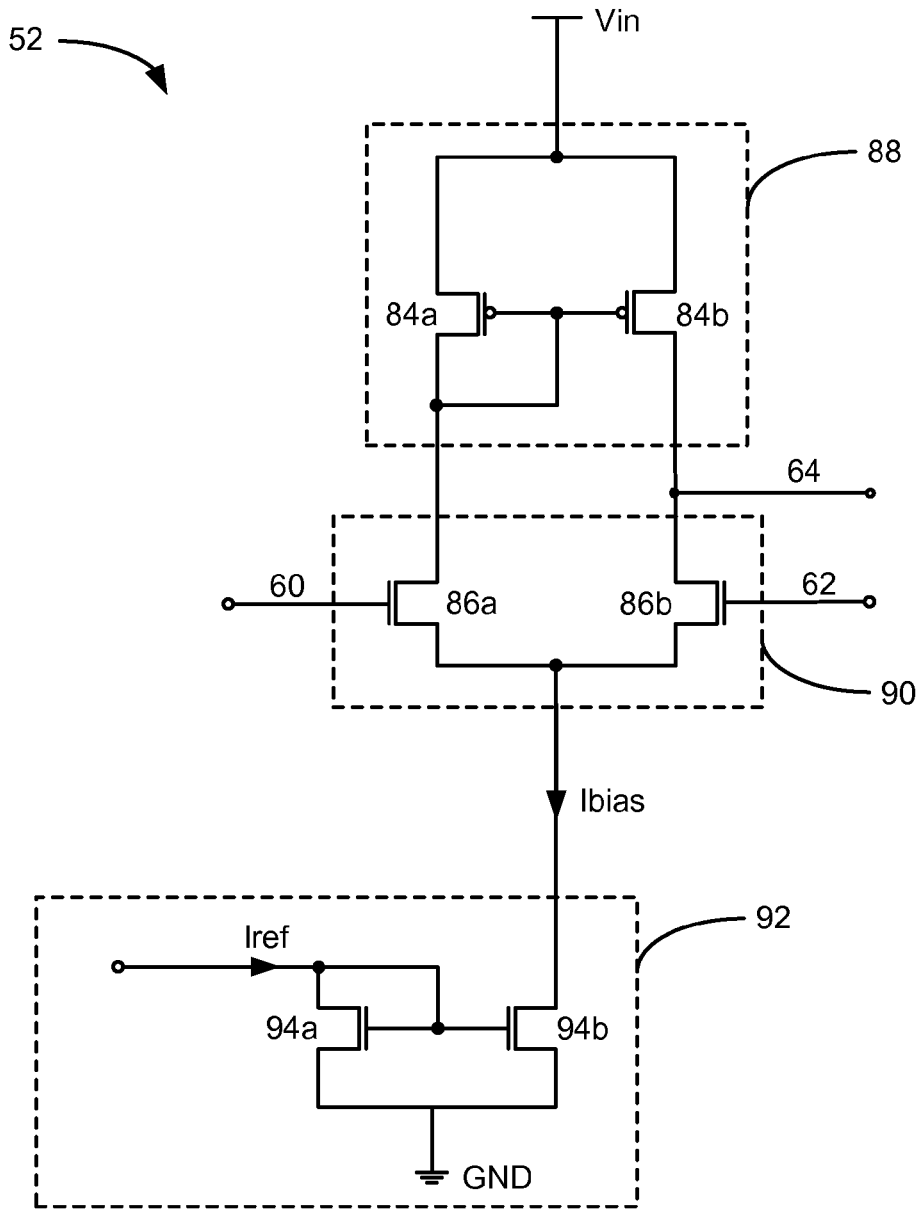
Figure 3 (prior art)
FIG. 3 shows a circuit diagram for a typical differential amplifier as used in the regulator of FIG. 2.

Fixed biasing circuit 192 is not selectable as before, and thus will contribute a set amount of current to Ibias. However, and unlike the prior art fixed biasing circuit 92 of FIG. 3, the current provided by fixed biasing circuit 192 (Imin) is minimal, i.e., the minimum amount required to operate the amplifier 152. Imin can be set by setting relative sizes of load elements 194*a* and 194*b*, providing a number of transistors 194*b* in parallel, etc. Although the error amplifier 152 shown here is a single-stage differential amplifier, other amplifiers such as multi-stage amplifiers operational amplifiers may also be used.

The values of the currents provided by each of the stages 156 are determined by the current mirror transistors 160 in each stage, which are used as current sinks. Just as transistor 194*b* is mirrored to transistor 194*a* in the fixed biasing circuit 192 to produce Imin, so too are the current mirror transistors 160 in each stage mirrored to transistor 194*a* to produce their respective currents. Thus, Ia can be set by fixing the size of transistor 160*a* relative to transistor 194*a*, by providing a number of transistors 160*a* in parallel, etc. By modifying the current mirror transistors 160 accordingly, the currents provided in each stage 156 can contribute different amounts of current to Ibias. For example, the currents in each stage can be linearly increased (e.g., Ia=Iref; Ib=2Iref; Ic=3Iref) or exponentially increased (e.g., Ia=Iref; Ib=2Iref; Ic=4Iref). Of course, more than the three stages 156 can be provided in the DAC 154, although only three stages 156*a-c* and three corresponding bias control signals 102*a-c* are illustrated for simplicity.

How the controller 80 adjusts Ibias in light of changing load conditions in illustrated in FIG. 7. Two tables 170 and 172 are illustrated. Table 172 illustrates the magnitude of Ibias given various combinations of the bias control signals 102. In this example, it is assumed that Imin=0.8 μA, Ia=10 μA, Ib=6 μA, and Ic=1 μA. The resulting Ibias (Imin+Ia+Ib+Ic) is shown in the column to the right in table 172. For example, when the bias control signals 102*a-c*='101', Ibias equals 11.8 μA (Imin+Ia+Ic).

Table 170 uses the information from table 172 to divine the required bias control signals 102*a-c* depending on which modules 72*a-c* are enabled via load enable signals 82*a-c*. In this example it is assumed that module 72*a* draws 15.1 mA when enabled; module 72*b* draws 3.5 μA when enabled; and module 72*c* draws 1.1053 mA when enabled. Thus, the total value of Iload is shown for various combinations of the assertion of load enable signals 82*a-c*. As mentioned earlier, the inventors have noticed that Ibias can be scaled with Iload, and hence it is assumed here that an ideal value for Ibias should be 0.1% of Iload, which values are shown in the appropriate column in table 170.

By matching the ideal values for Ibias in table 170 with the actual values for Ibias in table 172, the bias control signals 102 corresponding to the various combinations of enabled modules 72*a-c* can be ascertained. If one assumes that the actual value of Ibias should not be lower than its ideal value, one needs merely to pick the combination of bias control signals 102*a-c* that provide the smallest value higher than the ideal value from table 172. For example, note that when only module 72*c* is enabled (i.e., load enable signals 82*a-c*='001'), an ideal Ibias=1.1 μA. Consulting table 172, it is noticed that the smallest value higher than this is 1.8 μA, which is produced when bias control signals 102*a-c*='001'. This selection of bias control signals is thus included in table 170 for this load condition. In another example, note that any time module 72*a* is enabled (i.e., load enable signals 82*a-c*='1xx'), the ideal Ibias ranges from 15.1 to 16.2 μA. Consulting table 172, it is noticed that the smallest value higher than this is 16.8 μA, which is produced when bias control signals 102*a-c*='110'. This selection of bias control signals is thus included in table 170 for these load conditions.

Table 170, once determined via simulation or experimentation, can be stored in memory 104 associated with the controller 80. As will be seen further below, this will allow the controller 80 to pick the proper bias control signals 102 for a current or upcoming load condition. While the full range of information provided in table 170 has been useful to illustrate the disclosed technique, one skilled will realize that not all of the information in table 170 need be stored in the memory 104. Indeed, all that is required is some correlation between the load conditions and their corresponding bias control signals. Indication of the current or expected load conditions in memory 104 can take other forms than the enable signals 82, although use of the enable signals has been useful for illustration purposes.

One skilled will realize that FIG. 7 merely provides simple examples. The number of stages 156 in the DAC 154 and the number of bias control signals 102 can be changed, and these stages can provide currents of different values. Moreover, different numbers of modules 72 and corresponding load enable signals 82*a-c* could be used, which modules may draw different amounts of current. An ideal Ibias can also be determined differently than computing some percentage of Iload.

Figure 8:
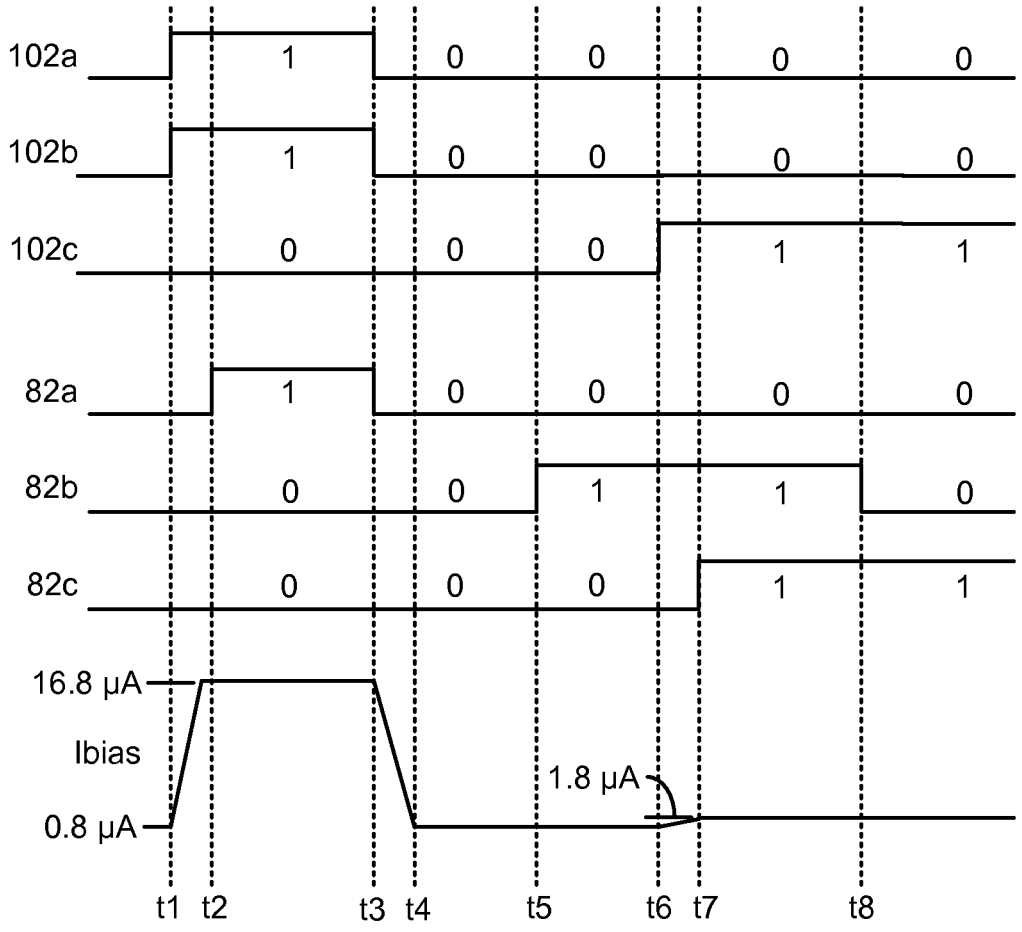
FIG. 8 shows an example of a timing diagram for the circuit of FIG. 5.

FIG. 8 illustrates how the controller 80 can time the assertion of the various bias control signals 102*a-c* and the load enable signals 82*a-c* in conjunction with table 170 stored in memory 104. As mentioned earlier, the controller 80 can know by virtue of its programming when various modules 72 are going to need to be enabled, and therefore can provide the appropriate bias control signals 102*a-c* to the error amplifier 152 at appropriate times.

For example, the controller 80 will understand prior to time t1 that it needs to enable module 72*a* only, and thus will eventually need to issue load enable signals 82*a-c*='100'. The controller 80 consults memory 104, and notes that this load condition correlates to bias control signals 102*a-c* of '110'. The controller 80 will also understand that prior to time t1 Ibias has been set to its minimal value of 0.8 μA, and accordingly that Ibias will need to be increased. Accordingly, the bias control signals are set at time t1, and Ibias begins to rise (to 16.8 μA per table 172) in anticipation of the increased load. By time t2, Ibias has stabilized at its new value, and the load condition (82*a-c*='100') is asserted.

At time t3, all modules 72*a-c* are to be disabled, and the load enable signals 82*a-c* will likewise be de-asserted (000'). The controller 80 can understand prior to t3, upon consulting memory 104, that the upcoming load change will result in a decrease in Ibias (back to 0.8 μA). As such, the controller 80 can decide at time t3 to assert the new load enable signals 82*a-c* and the new bias control signals 102*a-c*. This means that Ibias may be unnecessarily high for a short period between t3 and t4 as Ibias settles to its new lower value. While slightly wasteful of energy, such as excess of Ibias current between t3 and t4 will not adversely affect the performance of the error amplifier 152.

At time t5, module 72*b* is to be enabled, at which time the controller 80 will need to issue load enable signals 82*a-c*='010'. Prior to t5, the controller 80 consults memory 104, and notes that this new load condition does not warrant a change in Ibias. As such, the controller 80 can issue this new load condition at any convenient time (t5), and without concerns to Ibias requiring time to reach a new value.

Prior to time t6, the controller 80 understands that it will need to issue yet another new load condition, namely the additional activation of module 72*c*. In other words, the controller 80 knows it will eventually need to issue load enable signals 82*a-c*='011'. The controller can also understand from consulting memory 104 that Ibias will need to be increased (to 1.8 μA)—i.e., that bias control signals 102*a-c*='001' are warranted for this new load condition. Upon this understanding, the controller 80 can issue the new bias control signals 102*a-c* at time t6, and then issue the new load enable signals at time t7, after which Ibias can be assumed stable at its new value.

At time t8, module 72*b* is to be disabled, at which time the controller 80 will need to issue load enable signals 82*a-c*='001'. Prior to t8, the controller 80 consults memory 104, and notes that this new load condition does not warrant a change in Ibias. As such, the controller 80 can issue this new load condition at any convenient time (t8), and without concerns to Ibias requiring time to reach a new value.

In short, the controller 80, assisted by the information in memory 104, can understand how to time the assertion of new load enable signals 82 with the assertion of new bias control signals 102. The above explains that it is preferred to assert the bias control signals 102 in advance of the load enable signals 82 when Ibias is to be increased to ensure that Ibias will be appropriate for the Iload being drawn. However, this is not strictly necessary. The load enable signals 82 can always be asserted after the bias control signals 102, regardless of whether Ibias is increasing or decreasing. In any event, and beneficially, Ibias in the error amplifier is programmed to optimal values at any given time based upon the Iload required, and need not be set to a maximum value permissible for a maximum Iload, as occurred in the prior art. This saves power in the IPG 10, which as already noted is at a premium.

FIG. 9 illustrates another way in which the bias control signals 102*a-c* can be determined by the controller 80, and specifically illustrates that bias control signals 102*a-c* can correspond to the load enable signals 82*a-c*. In this example, there is a one-to-one correspondence between the currents provided by each of the loads 72*a-c* and each of the stages 156*a-c* in the DAC 154. Thus, as seen in table 170, load 72*c* draws Iload=X, and thus in table 172 (second row) Ic=0.001X by setting stage 156*c* to provide that current. (Again, this assumes that it is generally reasonable to set Ibias=Iload*0.1%). Load 72*b* draws Iload=3X in table 170, and thus in table 172 (third row) Ib=0.003X by setting stage 156*b* to provide that current. Load 72*a* draws Iload=6X, in table 170, and thus in table 172 (fifth row) Ia=0.006X by setting stage 156*c* to provide that current. In other words, each stage 156 in the DAC 154 is sized to contribute an amount to Ibias in accordance with a corresponding module 72. (In reality, Ibias will be greater than necessary given the contribution of Imin from fixed biasing circuit 192). As such, there is no need for the controller 80 to look up the proper bias control signals in memory 104, and so no look up table needs to be stored in association with the controller 80. Instead, the controller 80 will simply know based on the current or expectant load enable signals 82*a-c* to issue the corresponding bias control signals 102*a-c*. In other words, if the controller 80 is currently or expectantly issuing load enable signals 82*a-c*='xyz,' the controller can issue the same as bias control signals 102*a-c* 'xyz' without need of any look up in a memory 104.

Figure 4:
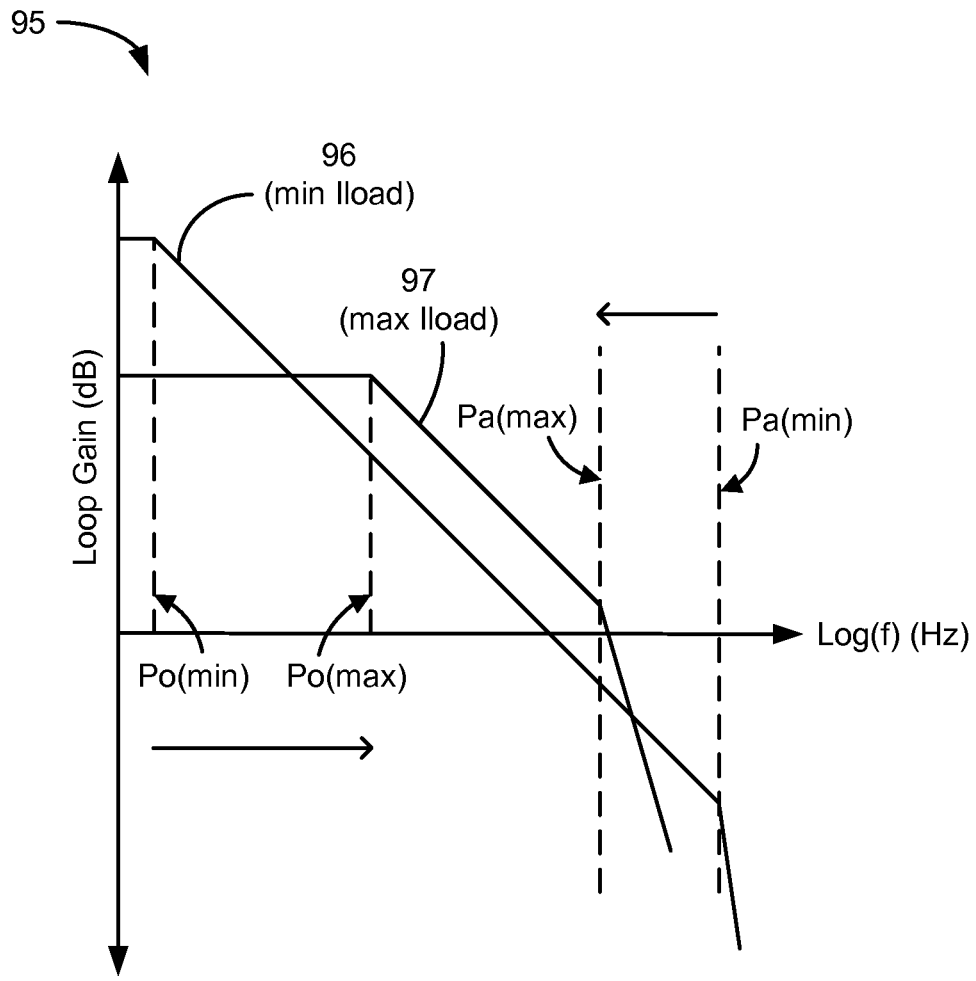
Figure 4 (prior art)
FIG. 4 shows an example of a Bode plot illustrating the gain characteristics of the regulator of FIG. 2.
Figure 10:
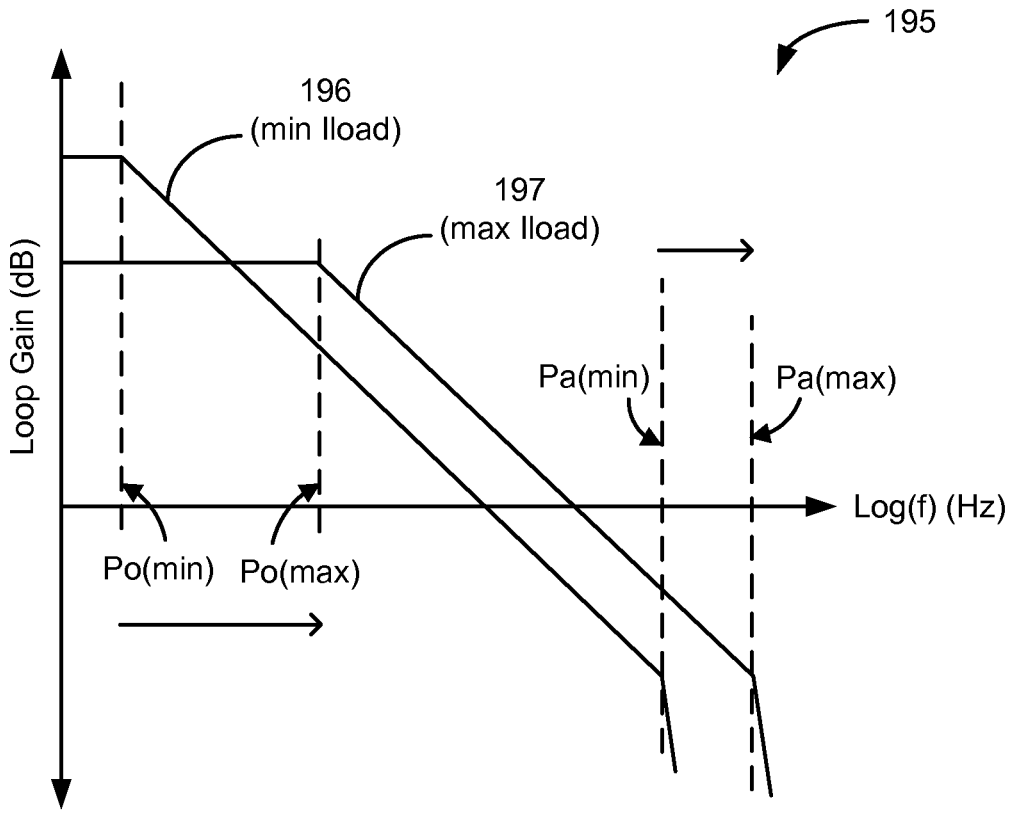
FIG. 10 shows an example of a Bode plot illustrating the gain characteristics of the regulator of FIG. 5.

As well as saving power, the system 105 and improved voltage regulator 150 have other advantages regarding voltage regulation stability. FIG. 10 illustrates an exemplary Bode plot 195 showing the open loop gain characteristics of the voltage regulator 150 of FIG. 5 for minimum (196) and maximum (197) Iload conditions, similar to what was illustrated earlier in FIG. 4. As shown by the arrows in FIG. 10, both poles Po and Pa increase as Iload increases. Such changes, particularly the change in Pa(max), results from the decrease in output resistance of the error amplifier 52 associated with an increased Ibias at a maximum Iload. The result represents stable operation of the regulator 150 during minimum and maximum load conditions, because both secondary poles Pa(min) and Pa(max) are located below the 0 dB threshold (compare FIG. 4). In short, the regulator 150's stability is improved compared to the prior art voltage regulator having a fixed Ibias.

While particularly useful in an implantable medical device, the disclosed system and voltage regulator are not so limited, and the inventors recognize that they can be used in any system requiring voltage regulation.

Although particular embodiments of the present invention have been shown and described, it should be understood that the above discussion is not intended to limit the present invention to these embodiments. It will be obvious to those skilled in the art that various changes and modifications may be made without departing from the spirit and scope of the present invention. Thus, the present invention is intended to cover alternatives, modifications, and equivalents that may fall within the spirit and scope of the present invention as defined by the claims.

The invention claimed is:

1. A system, comprising:

a voltage regulator including an amplifier, wherein the voltage regulator is configured to produce a regulated voltage from a first voltage;

a controller; and a plurality of loads, wherein the controller is configured to individually enable or disable each of the loads at any given time to draw power from the regulated voltage, wherein the controller is configured to issue a plurality of different control signals to adjust a bias current in the amplifier in accordance with the plurality of loads currently or expectantly enabled or disabled by the controller.

2. The system of claim 1, wherein the amplifier comprises a biasing circuit configured to receive the plurality of different control signals and to produce the bias current.

3. The system of claim 2, wherein the biasing circuit comprises a Digital to Analog Converter (DAC).

4. The system of claim 3, wherein the DAC comprises a plurality of stages each receiving one of the control signals.

5. The system of claim 4, wherein each control signal enables its stage to add a stage current to the bias current.

6. The system of claim 5, wherein a magnitude of the stage current in each stage is different.

7. The system of claim 3, wherein the biasing circuit also comprises a fixed biasing circuit configured to add a fixed current to the bias current.

8. The system of claim 1, wherein the amplifier is configured to receive an indication of the regulated voltage at a first input of the amplifier.

9. The system of claim 8, wherein the amplifier is configured to receive a reference voltage at a second input of the amplifier.

10. The system of claim 1, wherein the controller is associated with a memory, wherein the plurality of different control signals are retrieved from the memory in accordance with the loads currently or expectantly enabled or disabled by the controller.

11. The system of claim 1, wherein the controller is further configured to enable or disable each of the loads by issuing an enable signal to each of the loads.

12. The system of claim 11, wherein the controller is further configured to control the timing at which the control signals and the enable signals are issued.

13. The system of claim 1, wherein the plurality of loads perform different functions in an implantable medical device.

14. The system of claim 1, further comprising a battery, wherein the first voltage comprises a voltage of the battery.

15. The system of claim 1, wherein the system is implemented in an integrated circuit for an implantable medical device.

16. The system of claim 1, further comprising a pass transistor between the first voltage and the regulated voltage, wherein the pass transistor receives an output from the amplifier.

17. A system, comprising:

a voltage regulator including an amplifier, wherein the voltage regulator is configured to produce a regulated voltage from a first voltage;

a controller comprising a memory; and at least one load, wherein the at least one load is variable to cause a change in a load current provided by the regulated voltage, wherein plurality of different control signals are stored in and retrieved from the memory to adjust a bias current in the amplifier in accordance with a current or expected load current.

18. The system of claim 17, wherein the amplifier comprises a biasing circuit configured to receive the plurality of different control signals and to produce the bias current.

19. The system of claim 18, wherein the biasing circuit comprises an Digital to Analog Converter (DAC).

20. The system of claim 19, wherein the DAC comprises a plurality of stages each receiving one of the control signals.

21. The system of claim 20, wherein each control signal enables its stage to add a stage current to the bias current.

22. The system of claim 21, wherein a magnitude of the stage current in each stage is different.

23. The system of claim 19, wherein the biasing circuit also comprises a fixed biasing circuit configured to add a fixed current to the bias current.

24. The system of claim 17, wherein the amplifier is configured to receive an indication of the regulated voltage at a first input of the amplifier.

25. The system of claim 24, wherein the amplifier is configured to receive a reference voltage at a second input of the amplifier.

26. The system of claim 17, wherein the plurality of different control signals retrieved from the memory are dependent on a plurality of load enable signals used to set the current or expected load current.

27. The system of claim 17, wherein the controller is further configured to vary the at least one load via the plurality of enable signals.

28. The system of claim 27, wherein the controller is further configured to control the timing at which the control signals and the enable signals are issued.

29. The system of claim 17, further comprising a battery, wherein the first voltage comprises a voltage of the battery.

30. The system of claim 17, wherein the system is implemented in an integrated circuit for an implantable medical device.

31. The system of claim 17, further comprising a pass transistor between the first voltage and the regulated voltage, wherein the pass transistor receives an output from the amplifier.

32. A voltage regulator, comprising:

an amplifier;

a pass element configured to receive an output of the amplifier, wherein the pass element produces a regulated voltage from a first voltage, wherein the regulated voltage is configured to power one or more loads;

a feedback circuit configured to provide an indication of the regulated voltage to a first input of the amplifier;

a reference voltage provided to a second input of the amplifier; and a biasing circuit configured to provide a bias current to the amplifier, wherein the bias current is adjustable in accordance with a plurality of control signals, and wherein the plurality of control signals correspond to but are different from a plurality of load enable signals used to enable or disable the one or more loads.

33. The voltage regulator of claim 32, wherein the amplifier comprises a differential amplifier.

34. The voltage regulator of claim 32, wherein the biasing circuit comprises an Digital to Analog Converter (DAC).

35. The voltage regulator of claim 34, wherein the DAC comprises a plurality of stages each receiving one of the control signals.

36. The voltage regulator of claim 35, wherein each control signal enables its stage to add a stage current to the bias current.

37. The voltage regulator of claim 36, wherein a magnitude of the stage current in each stage is different.

38. The voltage regulator of claim 32, wherein the biasing circuit also comprises a fixed biasing circuit configured to add a fixed current to the bias current.

39. The voltage regulator of claim 32, further comprising a generator configured to produce the reference voltage.

40. The voltage regulator of claim 39, wherein the generator is a bandgap generator.

41. The voltage regulator of claim 32, wherein the pass element comprises a PMOS transistor.

42. The voltage regulator of claim 32, wherein the indication of the regulated voltage is provided by a voltage divider.

* * * * *